US009144778B2

(12) United States Patent
Manicardi

(10) Patent No.: US 9,144,778 B2
(45) Date of Patent: Sep. 29, 2015

(54) MACHINE AND METHOD FOR DISPENSING FLUID COLORING PRODUCTS

(71) Applicant: COROB S.P.A. CON SOCIO UNICO, San Felice Sul Panaro (IT)

(72) Inventor: Giuseppe Manicardi, Cavezzo (IT)

(73) Assignee: Corob S.p.a. Con Socio Unico, San Felice Sul Panaro (IT)

( * ) Notice: Subject to any disclaimer, the term of this patent is extended or adjusted under 35 U.S.C. 154(b) by 0 days.

(21) Appl. No.: 14/363,285

(22) PCT Filed: Dec. 5, 2012

(86) PCT No.: PCT/IB2012/002598

§ 371 (c)(1),
(2) Date: Jun. 5, 2014

(87) PCT Pub. No.: WO2013/084049

PCT Pub. Date: Jun. 13, 2013

(65) Prior Publication Data

US 2014/0319169 A1 Oct. 30, 2014

(30) Foreign Application Priority Data

Dec. 5, 2011 (IT) ..... UD2011A0198

(51) Int. Cl.
*B01F 13/10* (2006.01)
*B01F 15/00* (2006.01)
*B01F 15/04* (2006.01)

(52) U.S. Cl.
CPC ..... *B01F 13/1066* (2013.01); *B01F 15/00415* (2013.01); *B01F 15/042* (2013.01)

(58) Field of Classification Search
CPC ..... B01F 15/00415; B01F 15/042; B01F 13/1066
USPC ..... 222/135, 144, 144.5, 639, 642, 1, 63
See application file for complete search history.

(56) References Cited

U.S. PATENT DOCUMENTS 5,855,626 A * 1/1999 Wiegner et al. ..... 8/406
6,457,607 B1 * 10/2002 Andrea et al. ..... 222/63

(Continued)

FOREIGN PATENT DOCUMENTS

DE 30 16 167 A1 11/1981
EP 1 439 000 A2 7/2004

(Continued)

OTHER PUBLICATIONS

PCT Search Report and Written Opinion from PCT/IB2012/002598, 7 pages (Apr. 4, 2014).

*Primary Examiner* — Donnell Long
(74) *Attorney, Agent, or Firm* — Flaster/Greenberg P.C.

(57) ABSTRACT

Machine and method for dispensing fluid coloring products, each having a different color, to form a finished product having a desired color tone corresponding to a determinate formula, wherein an electronic control circuit comprises a central process unit and two electronic actuation circuits, each configured to be selectively associated to each motorized pumping member of the delivery circuits, so as to selectively cause the simultaneous drive of two motorized pumping members. The central process unit is programmed so as to reduce to a minimum the overall delivery time, by selectively coupling each of the two electronic actuation circuits to one of the motorized pumping members, as a function of the formula corresponding to the desired color tone.

6 Claims, 4 Drawing Sheets

(56) References Cited

U.S. PATENT DOCUMENTS

| | | | | |
|---|---|---|---|---|
| 6,726,065 | B2 * | 4/2004 | Sanders | 222/333 |
| 7,228,879 | B2 * | 6/2007 | Miller et al. | 141/271 |
| 8,161,865 | B2 * | 4/2012 | Tso et al. | 99/275 |
| 8,528,605 | B2 * | 9/2013 | Smith | 141/9 |
| 2007/0012378 | A1 | 1/2007 | Miller et al. | |
| 2007/0138203 | A1 * | 6/2007 | Sacchet | 222/144 |
| 2010/0143089 | A1 * | 6/2010 | Hvass et al. | 414/754 |

FOREIGN PATENT DOCUMENTS

| | | | |
|---|---|---|---|
| WO | WO 2007/017010 | A1 | 2/2007 |
| WO | WO 2011/161532 | A1 | 12/2011 |

* cited by examiner

MACHINE AND METHOD FOR DISPENSING FLUID COLORING PRODUCTS

BACKGROUND OF THE INVENTION

1. Field of the Invention

The present invention concerns a machine and a method for dispensing fluid coloring products, or more simply colorants, for example liquids, into a base product for paints, varnishes, enamels, inks or suchlike, contained in a closed container, to obtain a finished product with a particular color tone. The latter is defined by a determinate formula, understood here as a sequence of delivery circuits to be activated and the corresponding delivery times, associated to the different colorants and in proportion with a particular volume of the base product. In particular, the machine and the method according to the present invention are able to optimize, in a programmed and automated manner, the overall delivery time (Tce) of the colorants as a function of the corresponding formula, using at the same time at most two delivery nozzles.

2. Description of Related Art

It is known that, in order to obtain a particular coloring product, such as for example a paint, we start from a base product, normally a neutral color or white, contained in a suitable closed container or tin, into which, after holing the lid, colored pigments are introduced, in relatively small quantities (usually not more than 10% in volume) by means of one or many nozzles, and according to a determinate dosage, so as to obtain the desired color tone.

From the European patent application EP-A-1439000 a machine is known for dispensing fluid coloring products each having a different color, to form a finished product with the desired color tone.

Currently, with the most advanced known machines, for example the one known as Corobox® produced and marketed by Applicant, it is possible to obtain more than 37,000 different color tones, combining a limited number of colored pigments, for example from 1 to 9, according to determinate formulas.

The above machine Corobox® is described in the international patent application WO-A-2011/161532 in the name of the Applicant, the content of which is incorporated here in its entirety.

Known machines for dispensing fluid coloring products, as defined above, normally comprise a number of tanks, in the range of ten and even more (for example 16), in each of which a determinate fluid coloring product or pigment or colorant is contained, with a determinate color, such as for example white, blue, red, cyan, yellow, magenta and black. Each tank or group of tanks containing a colorant of the same color is connected to a delivery circuit comprising a delivery nozzle and a motorized pumping member to selectively dose the coloring pigments in the desired quantity and to convey them toward the delivery nozzles.

The known technological solutions provide, as alternatives, either a so-called simultaneous dosage, in which all the delivery circuits associated with the coloring products to be delivered and calculated with the corresponding formula are activated simultaneously, or a so-called sequential dosage, in which only one delivery circuit is activated at a time. In this second case the different delivery circuits and the respective tanks are normally mounted on a rotatable support that is selectively made to rotate so as to take, on each occasion, a determinate delivery nozzle in correspondence with the container, which remains stationary in a determinate position.

In machines where the dosage is carried out simultaneously, each delivery circuit is controlled autonomously and independently by a corresponding electronic actuation circuit, so that the number of the latter is the same as that of the delivery circuits. This first type of machine, with simultaneous delivery, manages to obtain maximum productivity, and hence short overall delivery times, even if it has the disadvantage that it is complex and costly because it uses a number of electronic actuation circuits identical to the number of delivery circuits. In particular, in this first type of machine, the overall delivery time (Tce) is equal to the delivery time of the preponderant colorant (Tep).

In machines where the dosage is carried out sequentially, there is a single electronic actuation circuit, which activates the delivery circuit selected on each occasion. This second type of machine is simpler, but has the disadvantage that it has a rather low productivity, and hence rather high overall delivery times (Tce). In fact, in this second type of machine, the overall delivery time (Tce) is equal to the sum of the individual delivery times (Te1, Te2, . . . Ten) of all the fluid coloring products delivered, present in the corresponding formula.

Normally the formulas consist of three colorants, but they can reach a maximum of 16. There are also formulas with 1 or 2 colorants. For example, to obtain a determinate light red color, the typical formula is as follows: red colorant=40 ml; yellow colorant=15 ml; magenta colorant=4 ml, so that all in all 59 ml are delivered.

If we hypothesize that the pumping power of each pump associated with a tank is for example 10 ml/second, then the overall delivery time (Tce) in a simultaneous delivery machine is 4 seconds, while the overall delivery time of a sequential delivery machine is 5.9 seconds, given by the sum of 4 seconds to deliver the red color, plus 1.5 seconds to deliver the yellow, plus 0.4 seconds to deliver the magenta.

BRIEF SUMMARY OF THE INVENTION

Purpose of the present invention is to obtain a machine and perfect a method for dispensing fluid coloring products which are simple, reliable and economical, and which at the same time reduce the overall delivery time compared with that of sequential dosage machines, without using a large number of electronic actuation circuits.

The Applicant has devised, tested and embodied the present invention to overcome the shortcomings of the state of the art and to obtain these and other purposes and advantages.

The present invention is set forth and characterized in the independent claims, while the dependent claims describe other characteristics of the invention or variants to the main inventive idea.

The new and original technical solution which obtains the above purpose and offers surprising and unforeseeable advantages, provides to simultaneously activate only two delivery circuits, chosen sequentially, based on a determinate program, among the many delivery circuits of the machine, using only two electronic activation circuits, which are able to each activate many delivery circuits. In this way, the different fluid coloring products are indeed delivered in sequence but two at a time, that is two in parallel. In fact, while a first delivery circuit is delivering the colorant of which a bigger quantity is required (for example the 40 ml of red colorant in 4 seconds, as in the case shown above), the second delivery circuit, at the same time as the first delivery circuit and in sequence with each other, delivers the other two fluid coloring products (for example first 15 ml of yellow colorant in 1.5 seconds and immediately afterward 4 ml of magenta colorant in 0.4 seconds). The overall delivery time (Tce) is the same (4 seconds) that a machine of the first type as described above would use, that is, with all the delivery circuits actuated simultaneously because, as usually happens in reality, the formula contains one colorant in a larger quantity than the others. When the formula contains more than three colorants, the machine according to the present invention is able to optimize the distribution of the colorants so that the overall delivery time (Tce) is as low as possible, as will be described in detail hereafter.

In fact, the situation in the example shown above is in reality almost a rule in formulas of any paint producer. Furthermore, for reasons connected to the controllability and stability of the finished product to be prepared, formulas of this type are always sought after. Consequently, a machine according to the present invention, with two-in-parallel dosage, that is, with only two electronic actuation circuits, often has the same productivity, or almost, of a machine with maximum parallelism, that is, with completely simultaneous delivery. The production costs can, however, be significantly lower. In fact, two electronic actuation circuits cost many times less than 16-18 electronic actuation circuits In particular, a dispensing machine according to the present invention, configured to dispense coloring fluid coloring products, each having a different color, to form a finished product having the desired color tone corresponding to a determinate formula, comprises at least a plurality of tanks, each of which is configured to contain one of the fluid coloring products having a determinate color, a determinate number of delivery circuits, more than two, connected to the tanks, in which each of the delivery circuits comprises at least a delivery nozzle and a motorized pumping member, to deliver determinate quantities of fluid coloring products in a determinate delivery time inside a container, and an electronic control circuit, provided with a central process unit and associated or associable with at least a first electronic memory in which are memorized the formulas that define the color tones that can be obtained, and configured to control the delivery circuits to cause the selective delivery of the fluid coloring products from the tanks to the container.

According to a characteristic feature of the present invention, the electronic control circuit comprises two electronic actuation circuits, configured to be selectively associated with each pumping member of the delivery circuits, to selectively cause the simultaneous drive of two of the motorized pumping members; the central process unit is programmed, for example by a suitable algorithm, to reduce to a minimum the overall delivery time (Tce), causing the selective connection of each of the two electronic actuation circuits to one of the motorized pumping members, as a function of the formula corresponding to the color tone desired.

According to another characteristic feature of the present invention, a dispensing method to dispense fluid coloring products, each having a different color, to form a finished product having a desired color tone, comprises a first step which provides to obtain a machine having at least a plurality of tanks each of which is configured to contain one of the fluid coloring products having a determinate color, a determinate number of delivery circuits, connected to the tanks, wherein each of the delivery circuits comprises at least a delivery nozzle and a motorized pumping member, to deliver determinate quantities of the fluid coloring products in a determinate delivery time inside a container, and an electronic control circuit, provided with a central process unit and at least a first electronic memory in which are memorized the formulas which define the color tones that can be obtained, and configured to control the delivery circuits so as to cause the selective delivery of the fluid coloring products from the tanks to the container. The method also comprises a second step in which the electronic control circuit, as a function of the color tone desired, establishes both which fluid coloring products are to be delivered and also the corresponding quantities and the delivery times (Te) of each of these, and a third step in which the control circuit, by means of two electronic actuation circuits, commands the selective simultaneous actuation of two of the delivery circuits, on the basis of at least a first algorithm able to reduce to a minimum the overall delivery time (Tce), selectively connecting each of the two electronic actuation circuits to one of the motorized pumping members, as a function of the formula corresponding to the desired color tone.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

DETAILED DESCRIPTION OF THE INVENTION

Figure 1:
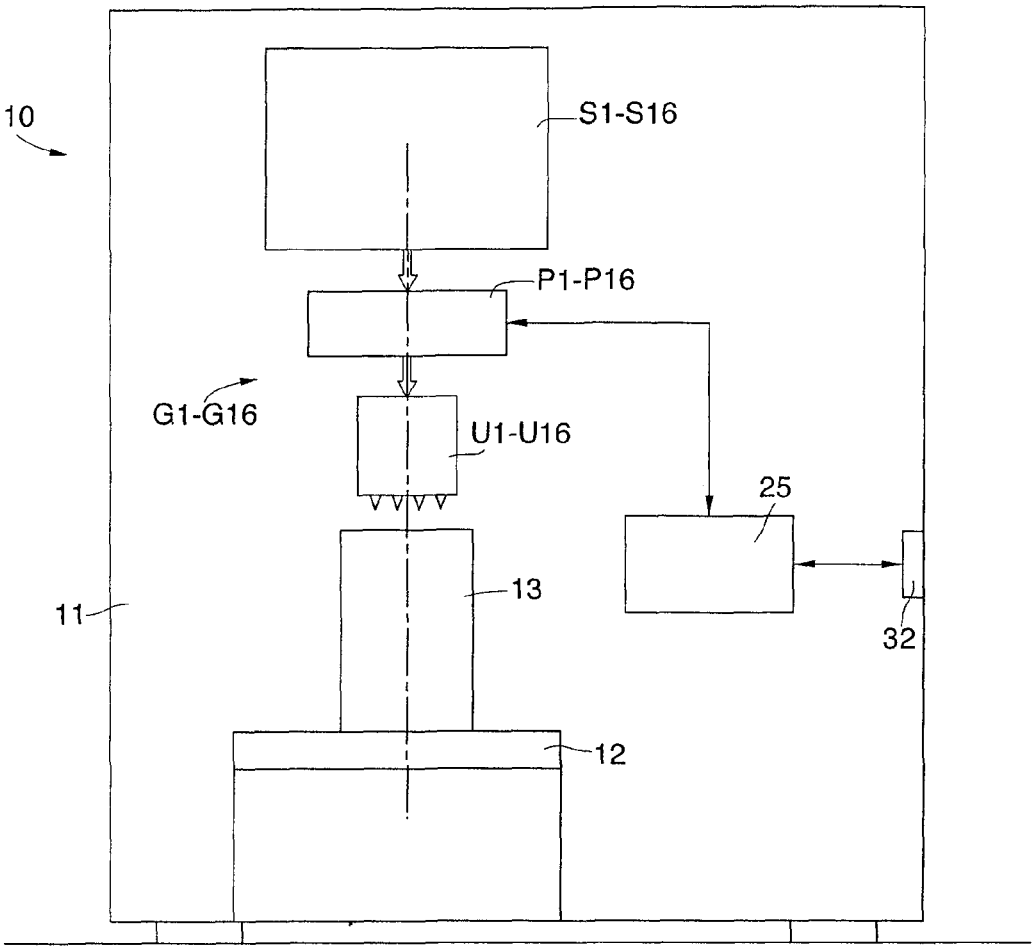
FIG. 1 is a schematized front view of a dispensing machine for fluid coloring products according to the present invention.

With reference to FIG. 1, a dispensing machine 10 for fluid coloring products according to the present invention comprises a frame 11 having a support 12 on which a container 13 is configured to be disposed, containing a base product for paints, varnishes, enamels, inks or suchlike.

Figure 2:
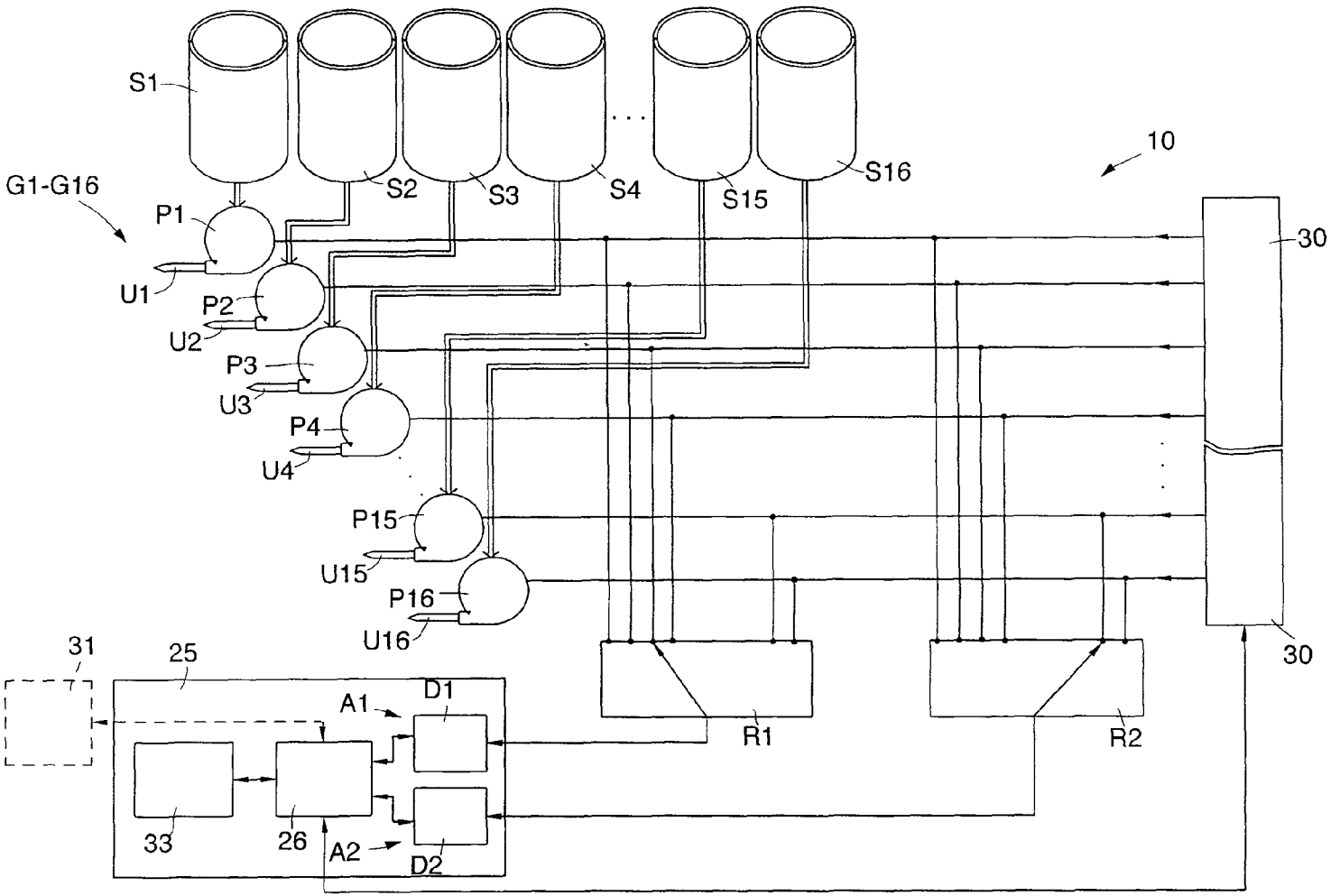
FIG. 2 is a block diagram showing the connections of some functioning components of the machine in FIG. 1.

On the upper part of the frame 11 a plurality of tanks are disposed, for example sixteen, from S1 to S16 (FIGS. 1 and 2), only six of which (S1-S4, S15 and S16) are shown schematically in FIG. 2. Each tank S1-S16 is configured to contain a colorant C having a determinate color. It is also provided that a colorant C of a determinate color, for example because it is very used compared to others, is contained in two or more tanks of the same type, which in this case will be hydraulically connected.

The dispensing machine 10 also comprises a plurality of delivery circuits G1-G16, equal in number to the tanks S1-S16, each of which comprises a motorized pump P1-P16, that is, a pump associated with an electric motor, and a delivery nozzle 18, which are configured to selectively deliver the fluid coloring products C inside the container 13. The delivery circuits G1-G16 can be of any known type, or a type that will be developed in the future, and therefore are not described in detail here.

The delivery circuits G1-G16, and in particular their motorized pumps P1-P16, are controlled by a control circuit 25, preferably of the electronic type, comprising at least a central process unit (CPU) 26 and two channels, or electronic actuation circuits A1 and A2. The latter each comprise a motor driver D1, respectively D2, connected to a selector R1, respectively R2.

The CPU 26 is also connected to a power circuit 30, of a known type, which is able to feed the electric motor of the motorized pumps P1-P16.

Both the first selector R1 and the second selector R2 are connected to all the exits of the power circuit 30, so that each selector R1 and R2 is able to activate, on a command from the CPU 26, any one whatsoever of the delivery circuits G1-G16, as will be described in more detail hereafter.

The CPU 26 is also associated or associable with a first electronic memory 31, which can reside in the same machine 10, or in an external electronic apparatus, such as for example a calculator, not shown in the drawings, to which the machine 10 is connected or connectable, by means of any known system, for example by means of a wireless connection, or by an electronic communication gate 31.

In the electronic memory 31 are memorized, for example in an electronic sheet, all the data, that is, the formulas F concerning the tens of thousands of color tones that can be obtained by mixing determinate fluid coloring products C, dosing the quantities, or defining the delivery times (Te) of each of them.

An example of how the electronic memory 31 can be organized is shown in the following Table 1, in which, for the sake of simplicity, only three determinate fluid coloring products are indicated (abbreviated to "colorants") C1, C2 and C3, while there may be sixteen colorants, from C1 to C16, although it is obvious that a person of skill shall be able to organize the electronic memory 31 differently and without difficulty.

In Table 1 the values of the times refer to a formula F for a container 13 containing 1 liter of base product. It is clear that the times will be modified proportionally when the base product contained in the container 13 is more or less than 1 liter.

TABLE 1

| No | COLOR TONE CODE | Delivery time (Te) of the colorant C1 (secs) | Delivery time (Te) of the colorant C2 (secs) | Delivery time (Te) of the colorant C3 (secs) |
|---|---|---|---|---|
| 1 | xxxxxxxxxxxxxxx | 10 | 7 | 3 |
| 2 | xxxxxxxxxxxxxxy | 3 | 4 | 5 |
| 3 | xxxxxxxxxxxxxyx | 6 | 10 | 7 |
| | . . . | | | |
| n | yyyyyyyyyyyyyyy | 12 | 6 | 6 |

The second column of Table 1 shows the codes of all the color tones that can be obtained with the machine 10 using the different quantities of the fluid coloring products contained in the tanks S1-S16.

The third, fourth and fifth columns of Table 1 show, in correspondence with each color code chosen or desired, the delivery times Te, in seconds, of each colorant C1, C2 and C3. Naturally, to each delivery time Te of each colorant C will correspond a corresponding quantity Q of fluid coloring product introduced by the delivery nozzles U1-U16 into the container 13. Thus, for example, if each delivery circuit G1-G16 is able to deliver 10 ml/sec., in two secs 20 ml will be delivered and so on.

The control circuit 25 also comprises a second memory 33, associated with the CPU 26, which for example is an EEPROM, that is, an Electrically Erasable Programmable Read-Only Memory, in which a program or firmware is memorized, which implements a first algorithm ALG, which comprises a second algorithm, a so-called maximum deviation, or MSS. The algorithm ALG is able to command the CPU 26 so that, depending on the formula F corresponding to the color tone desired, the two electronic actuation circuits or channels A1 and A2 are selectively combined, each to one of the motorized pumps P1-P16, to reduce to a minimum the overall delivery time (Tce) of the machine 10.

Before illustrating the algorithms ALG and MSS, the following preliminary definitions should be remembered:

- A formula F is an activation sequence of the delivery circuits G1-G16 associated with the different colorants C1-C16 and the corresponding delivery times Te. For example, FX=[('C1',10), ('C2',7), ('C3',3)] or FY=[('C11',3), ('C14',4), ('C16',5)]
- The delivery time of one circuit T(F)i is the time in seconds needed to deliver a colorant from the $n^{th}$ circuit in formula F. For example, $T(FX)_1=10$
- The sequential delivery time T(F) is the time, in seconds, needed to sequentially deliver all the colorants of a formula F. for example: T(F)=[10+7+3)]=20
- Difference in delivery time, in seconds, between the colorants of two formulas $D(F1,F2)_{i,j}$ is the deviation in the delivery time between two delivery circuits of two different formulas. For example: $D(F1,F2)_{1,1}=T(FX)_1-T(FY)_1=10-3=7$.

A sequential dispensing machine of a known type dispenses the colorants present in a formula in succession, from the biggest to the smallest.

Instead, as described above, in the machine 10 it is possible to simultaneously activate two delivery circuits G1-G16, exploiting the two motor drivers D1 and D2 individually connectable as desired to any circuit whatsoever.

To do this, each formula F is divided into two formulas F1, F2 so that T(F1)−T(F2) is as little as possible.

In arithmetic terms, the two formulas F1 and F2 deriving from formula F must be constructed so that the respective delivery times T(F1) and T(F2) are as close as possible to half the overall delivery time T(F)/2=M, because this would be the optimum value.

The search for the best distribution of the delivery circuits G1-G16 on the two channels A1 and A2 in order to minimize the overall delivery time (Tce) is a typical example of a combinatorial analysis problem (knapsack variant). The search for the optimum solution is complicated and laborious.

Simpler methods can be used, although these are not optimum, to get close to the ideal solution. For example the individual colorants C1-C16 can be allocated to the two channels A1 and A2, re-using the latter as they gradually become free.

However, let us consider the following formula:

$$F=[(C1:5),(C2:4),(C3:3),(C4:3)(C5:3)].$$

If we allocate in progression to the two channels A1 and A2 available the delivery circuits G1-G5 of the formula F, we have the following two formulas:

$$F1=[(C1:5),(C4:3),];T(F1)=8$$

$$F2=[(C2:4),(C3:3),(C5:3)];T(F2)=10$$

while it is easy to see that a better solution would be:

$$F1=[(C1:5),(C2:4),];T(F1)=9$$

$$F2=[(C3:3),(C4:3),(C5:3)];T(F2)=9$$

The method shown here, although it is not optimum, is simple however, and is near to optimum, and in the application to the machine 10 it offers very satisfactory results.

The algorithm MSS essentially comprises the following steps:

a) putting in F1 the formula with the biggest T(F);

b) considering the components (colorants) of the first formula F1 starting from the biggest and comparing them with each component of the second formula F2. If the difference in the delivery time of the components is smaller than the entrance deviation, memorizing the indexes and their deviation. Given the same deviation between the two formulas F1 and F2, keeping the one obtained with bigger delivery time values. If the two formulas F1 and F2 have different lengths, the components missing in the shorter one can be compared to components with zero duration;

c) the algorithm MSS terminates if, after exploring all the components of the first formula F1, comparing them with those of the second formula F2, no components are found with a deviation in the delivery time less than the entrance deviation.

Figure 3:
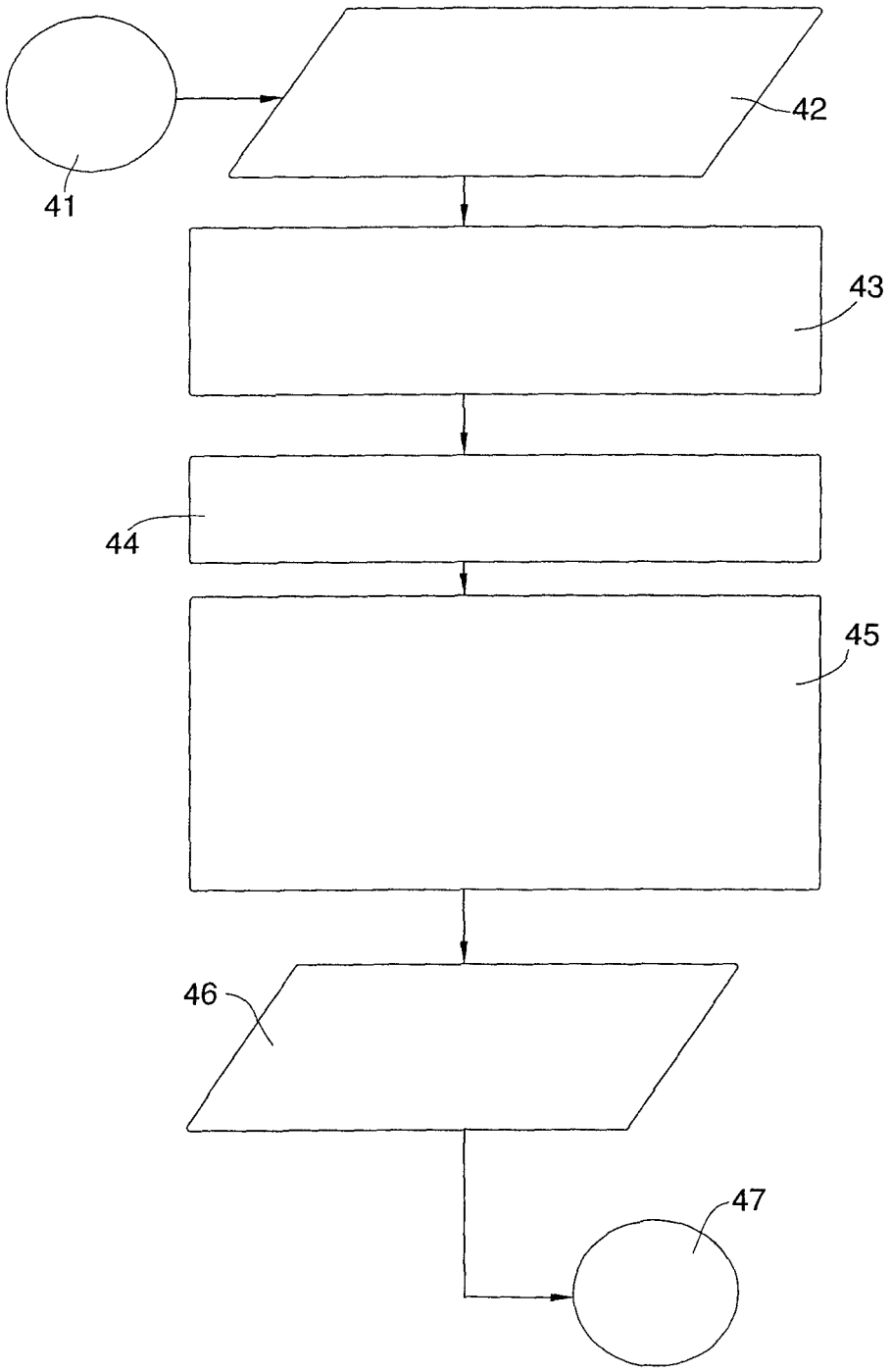
FIG. 3 is a first flow chart showing some steps of a dispensing method for fluid coloring products according to the present invention.

The algorithm MSS is also shown in the flow chart in FIG. 3, and comprises a start-of-program step 41, followed by an acquisition step 42 during which the CPU 26 receives the two formulas F1 and F2 and the deviation from the mean value Diff and orders the two formulas F1 and F2.

There then follows a first execution step 43, during which the formula with the biggest T(F) is put into F1, and the other in F2, wherein L1=Number of components of F1

L2=Number of components of F2.

There then follows a second execution step 44, during which ci=1, cj=1, Retci=0, retcj=0, retX=0.

There then follows a third execution step 45, during which, for all the possible ci from 1 to L1 and for all the possible cj from 1 to L2, if $T(F1)_{Ci}>T(F2)_{Cj}$ and if $X=(T(F1)_{Ci}-T(F2)_{Cj})<=\text{Diff}$. If X>ret X the return values are memorized: retci=ci, retcj=cj e retX=X.

There then follows a return step 46 during which retci. Retcj and retX are returned.

The algorithm MSS concludes with an end-of-program step 47.

Figure 4:
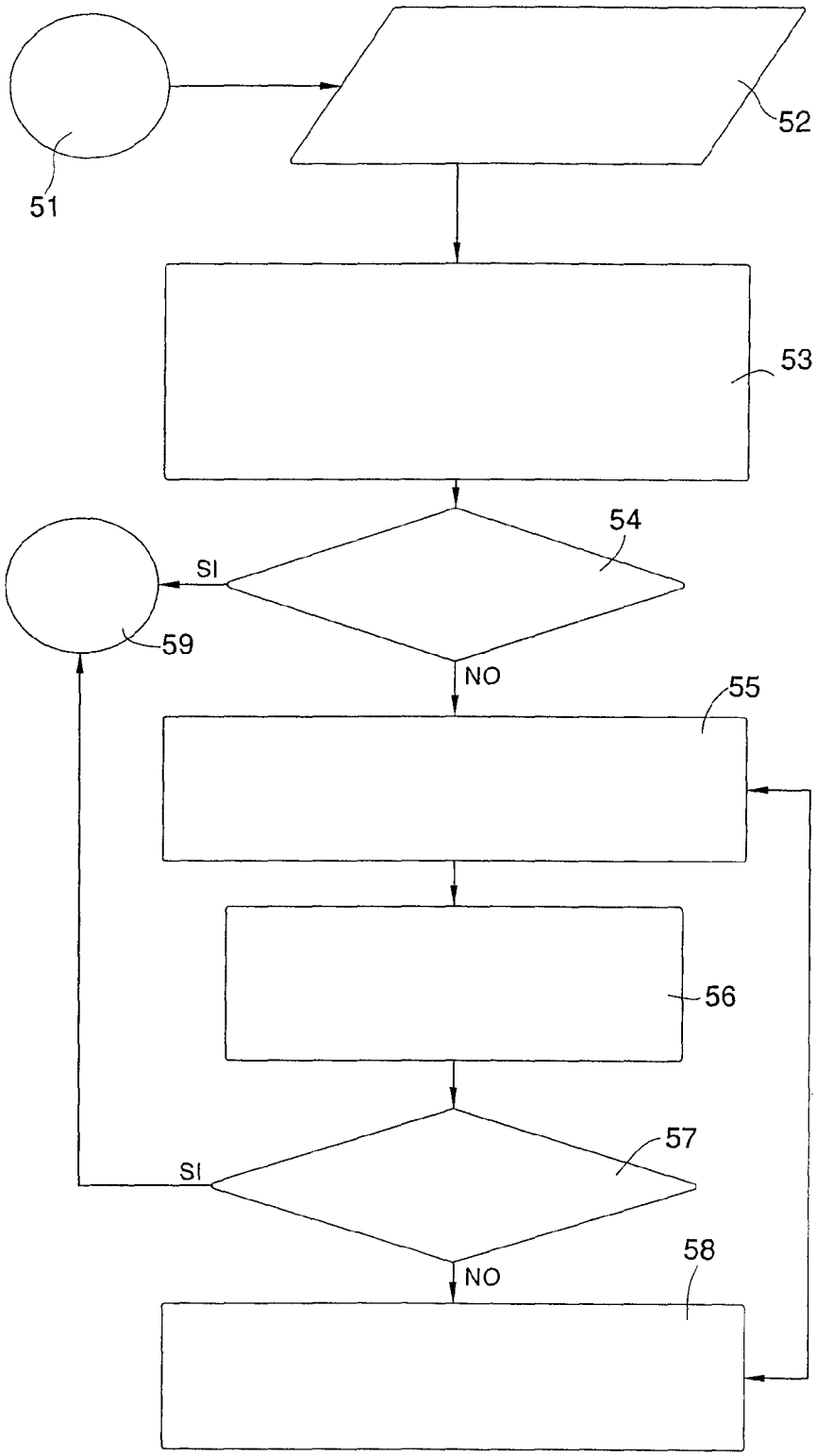
FIG. 4 is a second flow chart showing other steps of a dispensing method for fluid coloring products according to the present invention.

The algorithm ALG is shown in the flow chart in FIG. 4 and comprises a start-of-program step 51, followed by an acquisition step 52 during which by means of the CPU 26 the formula to be processed is acquired: F=[('Ci',xi) . . . ].

There then follows a first execution step 53 in which the formula F is ordered in decreasing order of delivery time (Te) of the delivery circuits G1-G16 concerned, and the mean value is calculated M=T(F)/2. The two formulas F1 and F2 are thus created, putting into F1 the components of the formula F until the mean value M is reached or exceeded. The remaining components are put into F2.

There then follows a first verification step 54 to verify whether T(F1) is equal to T(F2). If so, the end-of-program step 59 is started, whereas if not a second execution step 55 is begun in which the sequence is identified with the greater T(F), for example F1, and the difference with respect to T(F2) is calculated:

$$\text{Diff}=(T(F1)-T(F2)).$$

After the second execution step 55 there is a third execution step 56, during which the algorithm ALG as described above (F1, F2, Diff) is executed.

There then follows a second verification step 57, to verify whether there is any result. If so, the end-of-program step 59 is begun, whereas if not, a fourth execution step 58 is begun in which the components having indexes returned by MSS are exchanged between the two formulas F1 and F2, and the second execution step 55 is repeated.

Therefore, the algorithm ALG allows to essentially effect the following operations:

a) to order the formula F1 at entrance and generate two new formulas F1 and F2; to insert first the components into the first formula F1 until the mean delivery time value M is reached or exceeded; to insert the remaining components into F2;

b) to define as F1 the formula with the greater delivery time and the other as F2; to calculate the deviation in the delivery times as difference between T(F1) and T(F2);

c) to try to make exchanges between the components of the two formulas F1 and F2 so as to reduce the difference between the delivery times of the two formulas F1 and F2 so that they tend to the median value M.

EXAMPLES

We shall now supply some examples of formulas F and their processing with the algorithm AG:

Example 1

$$F=[(C1:5),(C2:4),(C3:3),(C4:3),(C5:3)];T(F)=18$$

$$F1=[(C1:5),(C2:4)];T(F1)=9$$

$$F2=[(C3:3),(C4:3),(C5:3)];T(F2)=9$$

$$\text{Diff}=T(F1)-T(F2)=0;\text{END}.$$

Example 2

$$F=[(C1:5),(C2:5),(C3:3),(C4:1)];T(F)=14$$

$$F1=[(C1:5),(C2:5)];T(F1)=10$$

$$F2=[(C3:3),(C4:1)];T(F2)=4;$$

$$\text{Diff}=T(F1)-T(F2)=6$$

The algorithm MSS returns 1,1,2; with the exchange we have:

$$F1=[(C3:3),(C2:5)];T(F1)=8$$

$$F2=[(C1:5),(C4:1)];T(F2)=6$$

$$\text{Diff}=T(F1)-T(F2)=2$$

The algorithm MSS returns 0,0,0; END.

Example 3

$$F=[(C1:10),(C2:10),(C3:4),(C4:4),(C5:1),(C6:1)];T(F)=30$$

$$F1=[(C1:10),(C2:10)];T(F1)=20$$

$$F2=[(C3:4),(C4:4),(C5:1),(C6:1)];T(F2)=10$$

$$\text{Diff}=T(F1)-T(F2)=10$$

The algorithm MSS returns 1,1,6; with the exchange we have:

$$F1=[(C1:10),(C4:4),(C5:1),(C6:1)];T(F1)=1$$

$$F2=[(C2:10),(C3:4)];T(F2)=14$$

$$\text{Diff}=T(F1)-T(F2)=2$$

The algorithm MSS returns 3,0,1:

$F1=[(C1:10),(C4:4),(C6:1)];T(F1)=15$ $F2=[(C2:10),(C3:4),(C5:1)];T(F2)=15$ $\text{Diff}=T(F1)-T(F2)=0;\text{END}.$ Example 4

$F=[(C1:7),(C2:7),(C3:5),(C4:4),(C5:3),(C6:3),(C7:3)];T(F)=32$ $F1=[(C1:7),(C2:7),(C3:5)];T(F1)=19$ $F2=[(C4:4),(C5:3),(C6:3),(C7:3)];T(F2)=13$ $\text{Diff}=T(F1)-T(F2)=6$ The algorithm MSS returns 1,1,3; with the exchange we have:

$F1=[(C2:7),(C4:4),(C3:5)];T(F1)=16$ $F2=[(C1:7),(C5:3),(C6:3),(C7:3)];T(F2)=16$ $\text{Diff}=T(F1)-T(F2)=0;\text{END}.$ Example 5

$F=[(C1:5),(C2:5),(C3:3),(C4:2),(C5:2)];T(F)=17$ $F1=[(C1:5),(C2:5)];T(F1)=10$ $F2=[(C3:3),(C4:2),(C5:2)];T(F2)=7$ $\text{Diff}=T(F1)-T(F2)=3$ The algorithm MSS returns 1,1,2; with the exchange we have:

$F1=[(C2:5),C3:3)];T(F1)=8$ $F2=[(C2:5),(C4:2),(C5:2)];T(F2)=9$ $\text{Diff}=T(F1)-T(F2)=1$ The algorithm MSS returns 0,0,0; END.

It should be noted that the condition for making exchanges between components of the two formulas F1 and F2 is that their deviation in the delivery time is much less than the deviation in the delivery time of the two formulas. Otherwise there would be a risk of falling into an infinite cycle. A simple example of this is the following formula:

$F=[(C1:10),(C2:8)];T(F)=18$ $F1=[(C1:10)];T(F1)=10$ $F2=[(C2:8)];T(F2)=8$ $\text{Diff}=T(F1)-T(F2)=2;$ but even exchanging the components repeatedly with each other, the result would never change.

From the numerous tests carried out by Applicant, it was possible to verify that the dispensing machine 10 is only 15% slower than a completely simultaneous machine of a known type, but considerably quicker, on average in the order of about 80%, than a completely sequential machine, that is, with only one nozzle.

Figure 5:
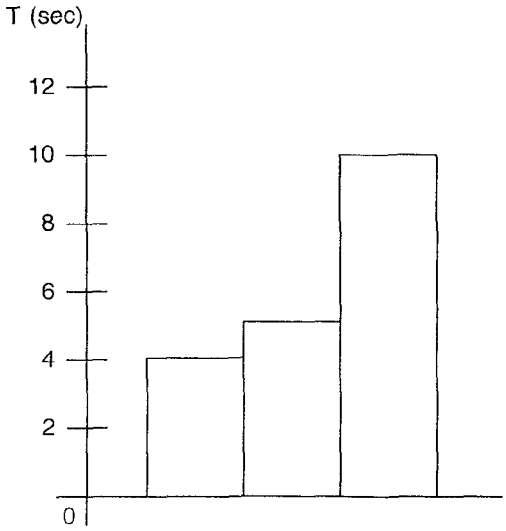
FIG. 5 is a bar diagram showing, in seconds, with the central bar, the overall mean delivery time of the machine in FIG. 1, compared with that of two known dispensing machines, one with simultaneous delivery (bar on the left) and the other with a completely sequential delivery (bar on the right).

The graph in FIG. 5 shows the data summarizing the above tests, wherein, for a container 13 containing 1 liter of base product: the left hand column shows the mean value of the overall delivery time (Tce) of a simultaneous delivery machine, which is about 4.5 seconds; the central column shows the mean value of the overall delivery time (Tce) of the dispensing machine 10, which is about 5.2 seconds; the right-hand column shows the mean value of the overall delivery time (Tce) of a sequential delivery machine, which is about 10.0 seconds.

We must point out that the result depends statistically on the entirety of the formulas F memorized in the first electronic memory 31. In particular, the delivery time tends to the optimum value T(F)/2=M as the number of components, that is, colorants, involved in the formula F increases, although normally there are never more than 3 or 4 of these.

It is clear that modifications and/or additions of parts may be made to the machine and method for dispensing fluid coloring products as described heretofore, without departing from the field and scope of the present invention.

It is also clear that, although the present invention has been described with reference to some specific examples, a person of skill in the art shall certainly be able to achieve many other equivalent forms of machines and methods for dispensing fluid coloring products, having the characteristics as set forth in the claims and hence all coming within the field of protection defined thereby.

I claim:

1. A machine for dispensing fluid coloring products, each having a different color, to form a finished product having a desired color tone corresponding to a determinate formula, comprising at least a plurality of tanks each of which is configured to contain one of said fluid coloring products having a determinate color, a determinate number of delivery circuits, more than two, connected to said tanks, wherein each of said delivery circuits comprises at least a delivery nozzle and a motorized pumping member, to deliver determinate quantities of said fluid coloring products in a determinate delivery time inside a container, and an electronic control circuit, provided with a central process unit associated, or associable, with at least a first electronic memory in which are memorized the formulas which define the color tones that can be obtained, said electronic control circuit being configured to control said delivery circuits so as to cause the selective delivery of said fluid coloring products from said tanks to said container, wherein said electronic control circuit also comprises two electronic actuation circuits, each configured to be selectively associated to each motorized pumping member of said delivery circuits, so as to selectively cause the simultaneous drive of two of said motorized pumping members and wherein said central process unit is programmed so as to reduce to a minimum the overall delivery time, by selectively coupling each of said two electronic actuation circuits to one of said motorized pumping members, as a function of the formula corresponding to the desired color tone.

2. The machine for dispensing fluid coloring products as in claim 1, wherein said electronic control circuit also comprises a second electronic memory, associated to said central process unit and in which a program is memorized which implements at least a first algorithm able to command said central process unit so that each of said two electronic actuation circuits is selectively coupled to one of said motorized pumping members.

3. The machine for dispensing fluid coloring products as in claim 2, wherein said first algorithm comprises a second algorithm, able to calculate the maximum deviation in the subdivision of the formula corresponding to the desired color tone.

4. The machine for dispensing fluid coloring products as in claim 1, wherein each of said two electronic actuation circuits comprises a motor driver and a selector.

5. A dispensing method to dispense fluid coloring products, each having a different color, to form a finished product having a desired color tone, comprising a first step which provides to make a machine having at least a plurality of tanks each of which is configured to contain one of said fluid coloring products having a determinate color, a determinate number of delivery circuits, more than two, connected to said tanks, wherein each of said delivery circuits comprises at least a delivery nozzle and a motorized pumping member, to deliver determinate quantities of said fluid coloring products in a determinate delivery time inside a container, and an electronic control circuit, provided with a central process unit and associated, or associable, to at least a first electronic memory in which are memorized the formulas which define the color tones that can be obtained, and configured to control said delivery circuits so as to cause the selective delivery of the fluid coloring products from said tanks to said container, wherein it also comprises a second step in which said electronic control circuit, as a function of the color tone desired, establishes both which fluid coloring products are to be delivered and also the corresponding quantities and the delivery times of each of these, and a third step in which said control circuit, by means of two electronic actuation circuits, commands the selective simultaneous actuation of two of said delivery circuits, on the basis of at least a first algorithm able to reduce to a minimum the overall delivery time, selectively connecting each of said two electronic actuation circuits to one of said motorized pumping members, as a function of the formula corresponding to the desired color tone.

6. The dispensing method as in claim 5, wherein said first algorithm comprises a second algorithm, able to calculate the maximum deviation in the subdivision of the formula corresponding to the desired color tone.

* * * * *